US006031332A

United States Patent [19]

Wijenberg et al.

[11] Patent Number: 6,031,332

[45] Date of Patent: Feb. 29, 2000

[54] METAL HALIDE LAMP HAVING SPECIFIC FILLING

[75] Inventors: Christoffel Wijenberg; Peter A. Seinen, both of Eindhoven, Netherlands

[73] Assignee: U.S. Philips Corporation, New York, N.Y.

[21] Appl. No.: 09/054,108

[22] Filed: Apr. 2, 1998

[30] Foreign Application Priority Data

Apr. 9, 1997 [EP] European Pat. Off. ..... 97201043

[51] Int. Cl.[7] ..... H01J 17/20

[52] U.S. Cl. ..... 313/637; 313/638; 313/639

[58] Field of Search ..... 313/567, 570, 313/571, 637, 638, 639, 640, 641, 643

[56] References Cited

U.S. PATENT DOCUMENTS 3,852,630 12/1974 Wesselink et al. ..... 313/228
5,424,609 6/1995 Geven et al. ..... 313/623

FOREIGN PATENT DOCUMENTS 0215524 3/1987 European Pat. Off. ..... H01J 61/30

*Primary Examiner*—Vip Patel
*Attorney, Agent, or Firm*—F. Brice Faller

[57] ABSTRACT

Metal halide lamp radiates light with a color temperature $T_c$ of between 3900 K and 4200 K and with a general color rendering index $R_a \geqq 90$. The ionizable metal halide filling comprises between 30 and 50 mole % $CaI_2$. The lamp has a limited crest factor, and accordingly a long useful life.

5 Claims, 1 Drawing Sheet

METAL HALIDE LAMP HAVING SPECIFIC FILLING

BACKGROUND OF THE INVENTION

The invention relates to a metal halide lamp provided with a discharge vessel with a ceramic wall which encloses a discharge space containing an ionizable filling which comprises besides Hg a molar quantity of halides of Na, Tl and at least one of the elements Dy and Ho.

A lamp of the kind mentioned in the opening paragraph is known from EP-A-0 215 524. The known lamp, which combines a high luminous efficacy with excellent color properties (among them general color rendering index $R_a \geqq 80$ and color temperature $T_c$ between 2600 and 4000 K) is highly suitable for use as a light source for inter alia interior lighting.

In this lamp, the recognition is utilized that a good color rendering is possible when Na halide is used as a filling ingredient of a lamp, and that a strong widening and inversion of the Na emission in the Na-D lines occurs during lamp operation. This requires a high temperature of the coldest spot $T_{cs}$ in the discharge vessel of, for example, 1170 K (900° C.). When the Na-D lines are inverted and widened, they assume the shape of an emission band in the spectrum with two maxima at a mutual distance $\Delta\lambda$..

The requirement that $T_{cs}$ should have a high value excludes under practical circumstances the use of quartz or quartz glass for the discharge vessel wall, and necessitates the use of a ceramic material for the discharge vessel wall.

A ceramic wall in the present description is understood to be a wall made from metal oxide, such as, for example, sapphire or densely sintered polycrystalline $Al_2O_3$, as well as from metal nitride, for example AlN.

The known lamp has a good color rendering and also a comparatively wide range for the color temperature.

In general, the known lamp is operated on an AC voltage supply source with a frequency of no more than 120 Hz. The discharge will be extinguished and subsequently be re-ignited in the lamp, once this has been ignited, upon each polarity change in the supply voltage. This re-ignition takes place at a voltage level, called re-ignition voltage hereinafter, which is higher than the stable arc voltage of the lamp. The ratio of the re-ignition voltage to the arc voltage is called crest factor. The crest factor assumes a comparatively high value in particular when the lamp is operated on a sinusoidal signal. The crest factor usually increases in value during lamp life. The lamp will not re-ignite anymore and remain off when the crest factor assumes a too high value. The required quantity of metal halide is found to lead to very high initial values for the crest factor and to a fast rise thereof through lamp life when a lamp having a color temperature $T_c$ in the range between 3900 K and 4500 K is realized. This adversely affects lamp life.

SUMMARY OF THE INVENTION

It is an object of the invention to provide a lamp in which a long useful life can be realized.

According to the invention, the ionizable filling of the lamp also comprises $CaI_2$ in a molar quantity which lies between 30 and 50% of the total molar quantity of the halides.

The lamp according to the invention has the advantage that the crest factor value remains limited also after some thousands of burning hours have elapsed, while it is surprisingly found that the excellent color properties of the lamp are hardly influenced, while also the luminous efficacy of the lamp is not adversely affected. No effective reduction of the crest factor can be found for a molar quantity of the $CaI_2$ below 30 mole %. When the molar quantity exceeds 50 mole %, on the other hand, a further reduction of the crest factor is indeed achieved, but at the same time the luminous efficacy of the lamp is substantially impaired. An implementation of the measure that the ionizable filling comprises besides halides of Dy and Ho also a halide of Tm has the advantage that an existing manufacturing technology can be used.

Limitation of the molar quantity of Tl halide to between 3 and 10% of the total molar quantity of halides has the advantage that the light radiated by the lamp has a color point which lies close to the blackbody line, said blackbody line being the geometrical locus or set of the color points of Planckian radiators. An additional advantage is that a small increase in the value of the general color rendering index $R_a$ is realized thereby. A desired high value for the color temperature $T_c$ can be realized at a total molar quantity of rare earth halides of Dy, Ho, and Tm which lies between 15 and 25 mole % of the total molar quantity of halides. Preferably, the ratio of the molar quantity of the Na halide to the molar quantity of rare earth halides is at most 2 in order to realize the desired color properties.

It is preferably realized by means of the measure according to the invention that the crest factor of the lamp according to the invention is below 2.3. This renders the lamp suitable as a retrofit lamp for existing lighting installations. Values for the crest factor above 2.3 gave the result that the lamp cannot be reliably operated in an existing installation.

BRIEF DESCRIPTION OF THE DRAWINGS

The above and further aspects of the lamp according to the invention will be explained in more detail with reference to a drawing (not true to scale), in which.

DESCRIPTION OF THE PREFERRED EMBODIMENTS

Figure 1:
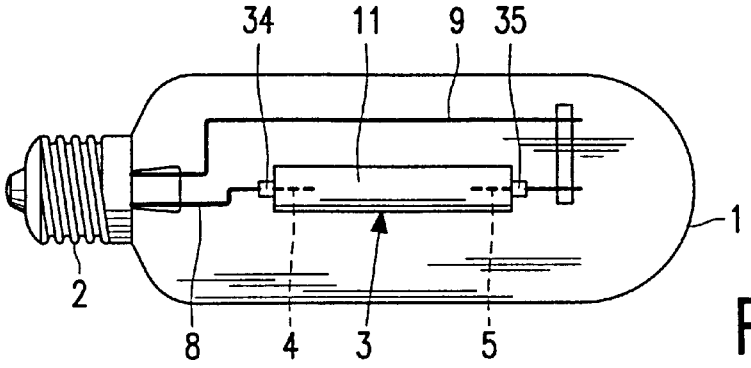
FIG. 1 diagrammatically shows a lamp according to the invention.
Figure 2:
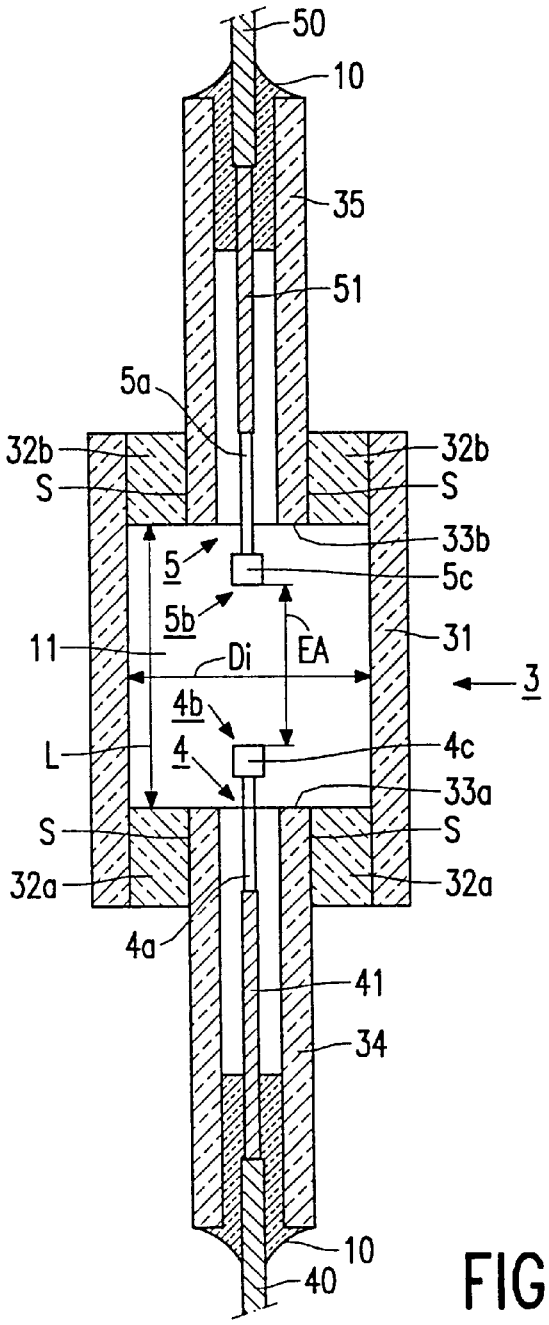
FIG. 2 shows the discharge vessel of the lamp of FIG. 1 in detail.

FIG. 1 shows a metal halide lamp provided with a discharge vessel 3 with a ceramic wall which encloses a discharge space 11 containing an ionizable filling which comprises besides Hg a molar quantity of halides of Na, Tl, and Dy. Two electrodes whose tips have an interspacing EA are arranged in the discharge space, and the discharge vessel has an inner diameter Di at least at the area of the interspacing EA. The discharge vessel is closed off at one end by means of a projecting ceramic plug 34, 35 which encloses with a narrow intervening space a current lead-through conductor (FIG. 2: 40, 41, 50, 51) to a respective electrode 4, 5 positioned in the discharge vessel, and is connected to the electrode in a gastight manner at a side facing away from the discharge space by means of a meltingceramic seal (FIG. 2: 10). The discharge vessel is surrounded by an outer bulb 1 which is provided with a lamp cap 2 at an end. A discharge extends between the electrodes 4 and 5 when the lamp is in the operating state. The electrode 4 is connected via a current conductor 8 to a first electrical contact which forms part of the lamp cap 2. The electrode 5 is connected via a current conductor 9 to a second electrical contact which forms part of the lamp cap 2. The discharge vessel, shown in more detail in FIG. 2 (not true to scale), has a ceramic wall and is formed by a cylindrical portion with an inner diameter Di bounded on either side by end wall portions 32*a*, 32*b* having a mutual distance L, each end wall portion 32*a*, 32*b* defining an end face 33*a*, 33*b* of the discharge space. The end wall portions each have an opening in which a projecting ceramic plug 34, 35 is fastened in the end wall portion 32*a*, 32*b* in a gastight manner by means of a sintered joint S. The projecting ceramic plugs 34, 35 each narrowly enclose a current lead-through conductor 40, 41, 50, 51 of a respective electrode 4, 5 having a tip 4*b*, 5*b*. The current lead-through conductor is connected to the projecting ceramic plug 34, 35 in a gastight manner by means of a melting-ceramic connection 10 at the side facing away from the discharge space.

The electrode tips 4*b*, 5*b* are situated at a mutual distance EA. The current lead-through conductors each have a respective portion 41, 51, for example in the form of a Mo—$Al_2O_3$ cermet, which is highly resistant to halides, and a portion 40, 50 which is fastened to a respective end plug 34, 35 in a gastight manner by means of the melting-ceramic connection 10. The melting-ceramic connection extends over a certain distance, for example approximately 1 mm, over the respective Mo cermet 41, 51. It is possible for the components 41, 51 to be formed in a manner other than from a Mo—$Al_2O_3$ cermet. Other possible constructions are known, for example, from EP-0 587 238 U.S. Pat. No. 5,424,609. A particularly suitable construction was found to be a highly halide-resistant coil wound around a similarly resistant pin. Mo is highly suitable as the material which is highly resistant to halides. The components 40, 50 consist of a metal whose coefficient of expansion corresponds very well to that of the end plugs. Nb, for example, is for this purpose a highly suitable material. The components 40, 50 are connected to the respective current conductors 8, 9 in a manner which is not shown in any detail. The lead-through construction described renders it possible to operate the lamp in any burning position.

Each electrode 4, 5 consists of an electrode rod 4*a*, 5*a* which is provided with a coiling 4*c*, 5*c* adjacent its tip 4*b*, 5*b*. The projecting ceramic plugs are fastened in the end wall portions 32*a*, 32*b* in a gastight manner by means of a sintered joint S. The electrode tips here lie between the end faces 33*a*, 33*b* formed by the end wall portions. In an alternative embodiment of a lamp according to the invention, the projecting ceramic plugs 34, 35 are recessed relative to the end wall portions 32*a*, 32*b*. The electrode tips in that case lie substantially in the end faces 33*a*, 33*b* formed by the end wall portions.

In a practical realization of a lamp according to the invention as described with reference to the drawing, the rated lamp power is 70 W and the luminous efficacy is 88 lm/W. The lamp, which is suitable for operation on an existing installation (retrofit lamp), has a lamp voltage of 91 V. The ionizable filling of the discharge vessel comprises 6 mg Hg, and 8 mg iodide salts as the molar quantity of halides of Na, Tl, Dy, Ho, Tm, and Ca having respective molar percentages of 29%, 6.5%, 6.5%, 6.5%, 6.5% and 45%. The Hg, which also serves to ensure that lamp voltage will be between 80 V and 100 V, which is necessary to comply with the retrofit requirement, has a pressure of 20 bar when the lamp is in the operational state. The filling further comprises Ar with a filling pressure of 140 mbar as an ignition gas.

The distance EA between the electrode tips is 6 mm, the distance L between the end faces is 8 mm, and the internal diameter Di is 7.4 mm. Photometric properties of the lamp were measured in an endurance test. The results are as follows. The crest factor in the case of operation by means of a supply source of 220 V, 50 Hz is 1.8 after 100 burning hours, 1.9 after 1000 burning hours, 2.05 after 2000 burning hours, and 2.07 after 5000 burning hours. The color temperature $T_c$ is 4214 K, 4222 K, 4260 K, and 4255 K at the moments of 100, 1000, 2000, and 4000 burning hours. The color point has the following co-ordinates at these moments (x,y): (0,370;0,365), (0,371;0,369), (0,369;0,368) and (0,370;0,369). The general color rendering index $R_a$ has a value of 92 after 100 burning hours. This value is 91 after 4000 burning hours.

In another practical realization of the lamp according to the invention, the rated lamp power is 39 W and the luminous efficacy is 90 lm/W. The ionizable filling of the discharge vessel comprises 3.3 mg Hg and 6 mg halide salts of the same composition as in the 70 W lamp described above. The lamp radiates light with a color temperature $T_c$ of 4019 K and with a general color rendering index $R_a$ of 90 in the operational state. The crest factor is 2.1 during operation on a public 220 V, 50 Hz mains.

In a further practical realization, the lamp with a power rating of 150 W has an ionizable filling of 7.6 mg Hg and 9 mg iodide salts of Na, Tl, Ho, and Ca in respective relative quantities of 41.5 mole %, 6.5 mole %, 22 mole %, and 30 mole %. The distance EA between the electrode tip in the discharge vessel is 11 mm, the distance L between the end faces is 14 mm, and the internal diameter Di is 9.2 mm. The luminous efficacy is 85 lm/W during operation, the crest factor is 2.07, the color temperature $T_c$ is 4208 K, and the general color rendering index $R_a$ is 94.

We claim:

1. A metal halide lamp provided with a discharge vessel with a ceramic wall which encloses a discharge space containing an ionizable filling which comprises Hg and a molar quantity of halides of Na, Tl and at least one of the elements Dy and Ho and further comprises $CaI_2$ in a molar quantity which lies between 30 and 50% of the total molar quantity of the halides.

2. A lamp as claimed in claim 1, characterized in that the ionizable filling further comprises a halide of Tm.

3. A lamp as claimed in claim 1 werein the total molar quantity of halides of Dy, Ho and Tm lies between 15 and 25% of the total molar quantity of the halides.

4. A lamp as claimed in claim 1, werein the molar quantity of Tl halide lies between 3 and 10% of the total molar quantity of the halides.

5. A lamp as claimed in claim 1, werein the ratio of the molar quantity of the Na halide to the molar quantity of the halides of Dy, Ho and Tl together has a value of at most 2.

* * * * *